United States Patent [19]

Gruber et al.

[11] Patent Number: 4,876,169

[45] Date of Patent: Oct. 24, 1989

[54] TONER COMPOSITIONS WITH RELEASE ADDITIVES THEREIN

[75] Inventors: Robert J. Gruber, Pittsford, N.Y.; Raymond A. Yourd, III, Cleveland Heights, Ohio; Shadi L. Malhotra, Mississauga, Canada; Robert A. Nelson, Webster, N.Y.; Carol A. Fox, Fairport, N.Y.; Thomas R. Hoffend, Webster, N.Y.

[73] Assignee: Xerox Corporation, Stamford, Conn.

[21] Appl. No.: 261,661

[22] Filed: Oct. 24, 1988

[51] Int. Cl.[4] ..... G03G 9/08

[52] U.S. Cl. ..... 430/110

[58] Field of Search ..... 430/110

[56] References Cited

U.S. PATENT DOCUMENTS

| | | | |
|---|---|---|---|
| 3,485,787 | 12/1987 | Haefele et al. . | |
| 4,298,672 | 11/1981 | Lu | 430/108 |
| 4,460,672 | 7/1984 | Gruber et al. | 430/110 |
| 4,517,272 | 5/1985 | Jadwin et al. | 430/110 |
| 4,770,968 | 9/1988 | Georges et al. | 430/110 X |
| 4,812,377 | 3/1989 | Wilson et al. | 430/110 X |

FOREIGN PATENT DOCUMENTS

| | | | |
|---|---|---|---|
| 58-11953 | 1/1983 | Japan | 430/110 |
| 58-11954 | 1/1983 | Japan | 430/110 |
| 58-121955 | 1/1983 | Japan | 430/110 |

*Primary Examiner*—Roland E. Martin

*Attorney, Agent, or Firm*—E. O. Palazzo

[57] ABSTRACT

A toner composition comprised of particles of a polyester with siloxane block segments therein, which particles have incorporated therein release additives.

31 Claims, No Drawings

TONER COMPOSITIONS WITH RELEASE ADDITIVES THEREIN

BACKGROUND OF THE INVENTION

This invention is directed to toner and developer compositions, and more specifically to toner compositions having incorporated therein release additives. Accordingly, in one embodiment of the present invention there are provided toner compositions comprised of certain polymers having incorporated therein release additives inclusive of silicone oils. Thus, for example, the toner compositions of the present invention are comprised of polymers, especially polyesters, containing polydialkyl siloxane units with hydroxy termination groups incorporated into the backbone of the polymer resin; and wherein the resin includes therein a release agent. The resulting toners can be selected for electrostatographic, especially xerographic, printing and imaging systems wherein release agent management devices for containing, directing and metering the release additive to the fixing roller are eliminated. Thus, the toner and developer compositions of the present invention are particularly useful in effecting the fusing of images with fuser systems wherein offset preventing devices for retaining and directing release fluids, such as silicone oils, is avoided. Advantages of the aforementioned composition permit a significant reduction in the cost of fusers by removal of offset preventing oil delivery hardware, consequent reduction in the cross sectional size of the fuser, reduced contaminants and dirt in the copying machine, and easier user maintenance. Additional benefits provided with the compositions of the present invention, particularly with known silicone elastomer fuser roll coatings, are enhanced roll stability (life) when a Release Agent Management (RAM) system is not employed. Also, with the toner compositions of the present invention, the release additives are controllably retained in the polymers selected, thereby avoiding undesirable leaching therefrom. Also, elimination of the release agent management system prevents the problem of not being able to write or type on a copy, which has been associated with large amounts of deposited oil. Further, with the toners containing the polyester polymers illustrated herein the release component, such as a silicone oil, is contained within the toner because of its compatibility with the siloxane backbone until its release by heat and pressure in the fuser nip present in electrophotographic systems. Simple oil addition to toners typically causes poor flow and a wet feel due to oil incompatibility with the toner resins. In addition, the toner compositions of the present invention can contain in various effective amounts other components including, for example, charge enhancing additives, carbon black, magnetite, color pigments or dyes; additives such as colloidal silicas, chemically modified colloidal silicas, metal salts, metal salts of fatty acids, reference U.S. Pat. No. 3,590,000, the disclosure of which is totally incorporated herein by reference, particulate polymers, various metal oxides, and the like, preferably on the surface thereof.

Numerous toner and developer compositions without silicone oils, including those which are useful in electrostatic imaging systems with fusers without release agent management oil delivery systems, are known, reference for example British Patent 1,442,835, the disclosure of which is totally incorporated herein by reference. Most of these fuser subsystems employ hard roll fusers, that is Teflon, whereas the present invention can be selected with silicone soft roll fusers, including those which utilize a functionalized silicone oil for which a release agent management system is employed. Specifically, there is disclosed in the aforesaid British Patent No. 1,422,835 toner compositions comprised of a styrene homopolymer or copolymer resin and at least one polyalkylene compound selected from polyethylene and polypropylene. According to the disclosure of this patent, reference page 2, beginning at line 90, the starting polymer resin may be either a homopolymer of styrene, or a copolymer of styrene with other unsaturated monomers, specific examples of which are disclosed on page 3, beginning at line 1. Polyalkylene compounds selected for incorporation into the toner compositions disclosed in this patent include those of a low molecular weight, such as polyethylene, and polypropylenes of an average molecular weight of from about 2,000 to 6,000.

Additionally, there is disclosed in U.S. Pat. No. 4,460,672 a developer composition mixture comprised of electrostatic toner particles consisting of resin particles, pigment particles, a low molecular weight waxy material with a molecular weight of from about 500 to about 20,000, and further included in the composition from about 0.5 percent by weight to about 10 percent by weight of a charge enhancing additive selected from, for example, alkyl pyridinium halides, organic sulfonate compositions, and organic sulfate compositions. The disclosure of this patent is totally incorporated herein by reference.

Also, there is disclosed in U.S. Pat. No. 4,206,247 a developer composition comprised of a mixture of resins including a low molecular weight polyolefin and alkyl modified phenol resins. More specifically, it is indicated in this patent, reference column 4, line 6, that the invention is directed to a process which comprises the steps of developing an image with toner particles containing in certain proportions at least one resin selected from group B, wherein the resins of group A include a low molecular weight polyethylene, a low molecular weight polypropylene, and similar materials; and wherein the group B resins include natural resin modified maleic acid resins, and naturally modified pentaerythritol resins. As examples of group A resins there are mentioned polystyrene, styrene series copolymers, polyesters, epoxy resins and the like, reference the disclosure in column 5, line 47. The molecular weight of the polypropylene or polyethylene selected is from about 1,000 to about 10,000, and preferably from about 1,000 to about 5,000.

In addition, there are illustrated in U.S. Pat. No. 4,517,272 toner compositions prepared by admixing certain toner polymers and low surface energy liquids, see column 1, beginning at line 65, and column 2, continuing on to line 45. More specifically, it is indicated in column 2, beginning at line 9, that the toner polymer which can be a thermoplastic or thermosetting polymer with preferred components such as a pigment and charge control agent, and with the low surface energy liquid such as a silicone oil, is provided. Particularly useful toner polymers include styrene acrylic copolymers, polyesters, and similar materials, reference the disclosure in column 2, beginning at line 45. Examples of low surface energy liquids that may be selected are outlined in column 3, beginning at line 7. Although the present invention is directed to related subject matter, there is selected substantially different polymers enabling, for example, the release fluid to be controllably retained therein, and thus allowing a controlled release of small amounts of release fluid during the fusing. Uncontrolled leaching of release fluid is a disadvantage associated with the toners of the '272 patent. Moreover, it is believed that U.S. Pat. No. 4,517,272 does not teach how the bulk added silicone oil is retained such that the toner flow is acceptable, or agglomerates are prevented.

Also of interest is U.S. Pat. No. 3,485,787 which is directed to hydrogenated block copolymers containing oils therein, and more specifically elastomers of the general configuration A-B-A which are prepared by extending with mineral oil the aforementioned hydrogenated block copolymers, see the Abstract of the Disclosure, for example. In U.S. Pat. No. 4,552,914, there are illustrated hydrocarbon block copolymers with dispersed polysiloxanes, and more specifically wherein there is dispersed a polysiloxane through a thermoplastic elastomeric hydrocarbon resulting in compositions which can display a remarkably smooth surface, see column 4, beginning at line 36. Other prior art of primarily background interest include European Patent Publication 167,259; Japanese Patent Publications 54-48245, 58-136051, 59-33460, and 60-186869. In the '69 Japanese publication, there are disclosed pressure fixable microcapsule toners consisting of a shell core containing a silicone oil; while the '245 publication illustrates a magnetic toner containing a thermoplastic resin with a small amount of silicone oil. In the '051 Japanese publication, there is illustrated a method whereby a fixing device is used containing a heat roller coated without the use of oil and wherein the developer consists of small amounts of an adhesion inhibitor of which silicone resin is mentioned as an example; while the '460 Japanese publication illustrates a latent image developing toner used to coat a heat roll without requiring oil, and wherein the toner consists of a thermoplastic resin which does not significantly melt onto the heat roll. The '914 patent discloses a composition consisting of a hydrocarbon block copolymer and small amounts of silicone oil and mineral oil, the block copolymer containing a styrene ethylene butylene styrene macromolecule with silicone oil and mineral oil dispersed throughout the copolymer. Also, with further respect to the '787 patent, note column 4, lines 10 to 13, where there is illustrated elastomeric block copolymers which might include copolymers of styrene butadiene in combination with up to 50 percent of mineral oil. None of the aforementioned reference, however, are directed to toner compositions or processes of utilizing these compositions wherein there is selected the polyester polymers of the present invention having incorporated therein release fluids.

Developer compositions can be selected for use in developing electrostatic images, wherein the toner image is fixed to a permanent substrate such as paper by contacting the paper with a roller, the surface of which is formed from a material capable of preventing toner particles from sticking thereto. In this process, however, the surface of the fixing roll is brought into contact with the toner image in a hot melt state, thus a part of the toner image can adhere to and remain on the surface of the roll. This causes a part of the toner image to be transferred to the surface of a subsequent sheet on which the toner image is to be successively fixed, thereby causing the well known undesirable offset phenomena.

In order to substantially eliminate offsetting, and more specifically for the purpose of preventing adhesion of the toner particles to the surface of the fixing roller, there has been selected certain types of rollers, the surface of which may be covered with a thin film of an offset preventing liquid such as a silicone oil. These oils are highly effective, however, the apparatus within which they are incorporated is complicated and costly as indicated herein since, for example, a means for feeding the oil is required. Also, not only do the silicone oils emit an undesirable odor, but these oils deposit on the machine components causing toner particles to collect on, and adhere to the silicone oils, which is highly undesirable. An accumulation of toner particles on machine components is troublesome in that image quality is adversely effected and these components must be periodically cleaned and/or replaced, adding to the maintenance costs of the machine system involved.

With the present invention, while release additives are utilized such as silicone oils, these additives are incorporated into certain polymer compositions thereby avoiding the need for costly components to enable management of the silicone oils selected for many of the prior art methods. Accordingly, there is a need for toner and developer compositions which are useful in electrostatographic printing and imaging systems wherein release management components are avoided. More specifically, there is a need for toner compositions wherein the release fluid is incorporated into the polymer and released therefrom during the fusing of the image to the supporting substrate. There is also a need for toner compositions wherein the release fluid such as silicone oils, mineral oils, or hydrocarbon oils that are present in the polymer avoid agglomeration of the resulting toner particles. Moreover, there is a need for toner compositions, including colored toner compositions that permit images of high quality and excellent resolution with substantially no background deposition, and wherein costly release management components are avoided. There also remains a need for toner compositions which are particularly useful in electrostatographic imaging processes having incorporated therein polysiloxane or fluoropolymer elastomer fuser rolls. There is also a need for processes of imaging wherein the release fluid is incorporated into certain polymers thereby overcoming several of the disadvantages of the prior art including the avoidance of a costly release management system, and wherein toner agglomerates are not formed; rather, the toner particles are free flowing. Furthermore, there is a need for toner and developer compositions comprised of resin particles which have incorporated therein release additives which can be controllably delivered in small effective amounts to prevent offsetting while not depositing large amounts of oil on the final copy which would cause problems when subsequently attempting to write or type on this copy.

SUMMARY OF THE INVENTION

It is an object of the present invention to provide toner and developer compositions with many of the advantages illustrated herein.

In another object of the present invention there are provided toner compositions with certain polymers having incorporated therein release additives.

Another object of the present invention residés in incorporating low viscosity fluids into certain polymers, and thereafter formulating toner and developer compositions useful in electrophotographic imaging processes wherein release management components are avoided.

Furthermore, in another object of the present invention there are provided toner compositions containing polyesters with segments of siloxane in the backbone, and wherein the aforementioned polymers have incorporated therein silicone oils thereby permitting the formulation of free flowing toner compositions useful in electrostatographic printing and imaging processes while simultaneously avoiding the need for costly release management components.

Moreover, another object of the present invention resides in toner and developer compositions wherein the release fluid is permanently retained in the polymer or on the surface thereof until fusing of the images is accomplished in an electrostatographic imaging device.

These and other objects of the present invention are accomplished by the provision of toner and developer compositions comprised of certain polymers having incorporated therein release fluid additives. In one embodiment of the present invention, there are provided toner compositions comprised of polymers of the polyester group with segments of siloxane therein, such as dimethyl siloxane in the backbone thereof, which polymers have incorporated therein release fluids inclusive of silicone oils. Another embodiment of the present invention resides in toner compositions containing therein, for example, charge enhancing additives, carbon black, magnetite, color pigments or dyes, and surface additive components such as colloidal silicas, chemically modified colloidal silicas, metal salts of fatty acids, particulate polymers, various metal oxides, and the like.

In one specific embodiment of the present invention, there are provided toner compositions containing polyesters with siloxane block segments therein and wherein the polyester has incorporated therein release fluids such as silicone oils. Specifically, the toner compositions of the present invention in an embodiment are comprised of the aforementioned polyester component with siloxane block segments therein, release additives incorporated into the polyester polymers, and pigment particles. Moreover, the toner composition can contain charge enhancing additives, for example, in an amount of from about 0.1 to about 10 percent by weight including alkyl pyridinium halides, distearyl dimethyl ammonium methyl sulfate, and the like. Developer compositions are formulated by admixing the aforementioned toner compositions with carrier particles as illustrated herein.

Examples of charge enhancing additives usually present in an amount of from about 0.1 to about 10, and preferably 5 weight percent, include alkyl pyridinium halides, especially cetyl pyridinium chloride, reference U.S. Pat. No. 4,298,672, the disclosure of which is totally incorporated herein by reference; organic sulfates and sulfonates, reference U.S. Pat. No. 4,338,390, the disclosure of which is totally incorporated herein by reference; distearyl dimethyl ammonium methyl sulfate and similar additives, reference U.S. Pat. No. 4,560,635, the disclosure of which is totally incorporated herein by reference; and the like. As indicated herein, the toner composition may include, preferably as surface additives in an amount, for example, of from about 0.1 to about 1 percent by weight, of colloidal silicas, metal salts and metal salts of fatty acids such as zinc stearate, reference U.S. Pat. Nos. 3,590,000; 3,720,617; and 3,900,588, the disclosures of which are totally incorporated herein by reference.

The polyester polymers selected for the toner compositions of the present invention can be prepared by a number of various methods including condensation polymerization in the presence of catalysts, and wherein there are incorporated into the polymer disilanol terminated polyalkyl siloxanes in addition to diacids or diesters, and dialcohol monomers. Specifically, thus the polyester polymeric component can be prepared by condensation polymerization from a polyester synthesized from a dialkyl terephthalate and alcohol components containing, for example, propanediol and butanediol, pentaerythritol, and silanol terminated polydialkyl siloxanes as further illustrated herein which reaction is accomplished in the presence of a catalyst as an isopropyl titanate, and wherein the reaction is effected by heating at a temperature, for example, to enable polymerization to occur, such as about 200° C. for various effective time periods of, for example, from about 3 to about 10 hours. Thereafter, there is added to the formed polymer with mixing a release fluid, such as a silicone oil, while the polymer is in the molten form. Subsequently, the polymer is cooled to room temperature by, for example, pouring it into stainless steel trays. Thereafter, toner compositions can be prepared by admixing the resulting polyester block polymers obtained with, for example, pigment particles and other additives as illustrated herein.

Examples of polydialkyl and particularly disilanol terminated polydimethyl siloxanes selected for the toner resin polyester polymers of the present invention with a molecular weight of preferably from about 400 to about 44,000 include those of the following formula

I.

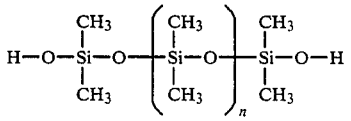

wherein n represents the number of repeating units and is, for example, a number of from about 1 to about 200. The number of blocks of siloxane can be varied by changing the concentration of disilanol terminated polydimethyl siloxane from about 5 percent to about 25 percent.

Illustrative examples of diacids include terephthalic acid, trans-hexahydro terephthalic acid, p-carboxyphenyl acetic acid, diphenyl-p,p'-dicarboxylic acid, diphenyl-4,4'-diacetic acid, diphenylmethane-p,p'-dicarboxylic acid, benzophenone-4,4'-dicarboxylic acid, naphthalene-2,7-dicarboxylic acid, naphthalene-2,6-dicarboxylic acid, p-carboxyphenyloxy acetic acid, 1,2-diphenoxyethane-p,p'-dicarboxylic acid, 1,3-diphenoxypropane-p,p'-dicarboxylic acid, 1,4-diphenoxybutane-p,p'-dicarboxylic acid, p(p-carboxyphenoxy) benzoic acid, p(p-carboxybenzoyloxy)benzoic acid, adipic acid, sebacic acid, maleic acid, fumaric acid, phthalic acid, isophthalic acid, azelaic acid, succinic acid, their analogous anhydrides, and the esters, acid chlorides and salts thereof. If desired, more than one diacid, anhydride, acid chloride or salt can be employed to form a copolyester.

As examples of the dialcohol component there can be selected ethylene glycol, 1,2-propanediol, 1,3-propanediol, 1,3-butanediol, 1,4-butanediol, 1,5-pentanediol, neopentyl glycol, hexamethylene glycol, heptamethylene glycol, octamethylene glycol, nonamethylene glycol, decamethylene glycol, diethylene glycol, triethylene glycol, tetraethylene glycol, p-di(hydroxymethyl)-benzene, cis and trans quinitol, hydroquinone, hydroquinone di-(β-hydroxyethyl)ether, 4,4'-dihydroxy biphenyl, bis-(4-hydroxyphenyl)methane, bis-(4-hydroxyphenyl)diphenylmethane, bis-(hydroxyphenyl)ketone, bis-(hydroxyphenyl)ether, bis-(hydroxyphenyl)sulphone, Dow 565 (the diether of propylene glycol and bisphenol A), and the like. Multifunctional alcohols such as glycerol, trimethylol propane, or pentaerythritol could also be incorporated into the final polyester polymer.

The aforesaid polyesterification reaction is usually accomplished at temperatures of from about 130° C. to about 270° C. under a vacuum, such as about 600 to about 0.1 millimeters of mercury.

The disilanol terminated polydimethyl siloxane monomers incorporate into the growing polymer as would other dialcohol monomers. That is, if reacted with a diacid, the siloxane dialcohol would be joined to the growing chain while H-O-H (water) is eliminated. If reacted with a diester, the siloxane dialcohol would be joined to the growing chain while a low molecular weight alcohol (R-O-H), such as methanol, is eliminated.

The reaction is typically catalyzed by employing small amounts, for example from about 0.5 to about 10 weight percent, of strong acids such as sulfuric acid or p-toluene sulfonic acid, or bases such as the hydroxides of potassium, lithium and others, and oxides of lead, sodium and magnesium. Also, other catalysts known in the art can be used such as zinc chloride, phosphites, titanium isopropoxide, tetrabutyl titanate, tetrabutyl zirconate, zirconium naphthenate, tetraphenyltin, zinc acetate, zinc naphthenate, manganese naphthenate, and the like.

Various release fluids in an amount of from about 1 percent to about 10 percent by weight can be added or incorporated into the aforementioned polymers. These fluids include low surface energy liquids such as silicone oils, for example dimethyl silicone fluid, methyl phenyl silicone fluid, chlorophenyl methyl silicone fluid, hydrocarbon oils, and the like.

Although it is not desired to be limited by theory, it is believed that the selection of the specific polymers mentioned herein possess properties permitting the release fluid additives to remain therein or at the surface thereof, and moreover there are enabled free flowing toner compositions, that is the toner particles do not agglomerate. Specifically, the incorporation of dimethyl siloxane blocks in the polymer provide sites at which the silicone release fluid may congregate, that is the solubility rule "like dissolves like". At normal temperatures outside of the fuser roll temperature, these areas would controllably contain the release fluid and enable the toner to be free flowing, that is the surfaces would not stick together. At the elevated temperature of the fuser roll, the toner would be above the Lower Critical Solution Temperature (LCST) of the "compatible blend" which exists between the release fluid and dimethyl siloxane block of the polymer, and phase separation of the oil and the toner would occur. Since the toner would also be softened at the temperatures and pressures usually employed in electrophotographic systems, for example, the release component such as the silicone oil would be able to controllably migrate to the surface of the toner and could then transfer to the fuser roll to accomplish release and prevent offsetting. With the materials mentioned in the '272 patent, which do not specifically incorporate chemical structure which is compatible with the added release fluid, the toner particles may agglomerate as the release fluid uncontrollably migrates to the toner surface. By tailoring the amount of dimethyl siloxane segment polymerized into the polymer, and the amount of oil blended with the polymer to the fuser system, the amount of oil can be controllably released as needed.

Various suitable colorants and/or pigment particles may be incorporated into the toner and developer composition of the present invention including, for example, carbon black, Nigrosine dye, magnetic particles, such as Mapico Black, a mixture of iron oxides, and the like. The pigment particles are present in the toner in sufficient quantities so as to render it highly colored enabling the formation of a visible image on a recording member. Thus, for example, the pigment particles, with the exception of magnetic materials, should be present in the toner composition in an amount of from about 2 percent by weight to about 15 percent by weight, and preferably from about 2 percent by weight to about 10 percent by weight. With regard to magnetic pigments such as Mapico Black, they are generally incorporated into the toner composition in an amount of from about 10 percent by weight to about 70 percent by weight, and preferably in an amount of from about 20 percent by weight to about 50 percent by weight.

While the magnetic particles can be present in the toner composition as the only pigment, these particles may be combined with other pigments such as carbon black. Thus, for example, in this embodiment of the present invention, the other pigments are present in an amount of from about 10 percent by weight to about 15 percent by weight mixed with from about 10 to 60 percent by weight of magnetic pigment. Other percentage combinations may be selected provided the objectives of the present invention are achieved.

Usually the polyester polymer is present in the toner in the amount of from about 10 to about 90 percent by weight, however, preferably from about 70 to about 85 percent by weight of polymer content is selected. Furthermore, the toner compositions of the present invention can be prepared by any number of known melt blending methods such as extrusion or Banbury processing wherein the pigment particles are blended with the resin particles and release fluids simultaneously, or with resin particles having the release fluid such as silicone oils already blended therein after polymerization. The extrusion or Banbury processing product is then subjected to mechanical attrition, and classification to permit toner size particles, for examples, about 9 to about 20 microns in average diameter. The toner compositions may contain, as illustrated herein, other components, especially internal additives, including for example, charge enhancing additives, carbon black, magnetite, color pigments or dyes, and on the toner surface in an amount, for example, of from about 0.1 to about 5 weight percent, and preferably 0.7 to about 1.5 weight percent, additives such as colloidal silicas, chemically modified colloidal silicas, metal salts of fatty acids, reference U.S. Pat. No. 3,590,000, the disclosure of which is totally incorporated herein by reference, particulate polymers, various metal oxides, such as aluminum oxides, and the like.

Illustrative examples of various carrier materials selected for preparation of the developer composition include those substances that are capable of triboelectrically obtaining a charge of opposite polarity to that of the toner particles including, for example, steel, iron ferrites, and the like. These carriers can be used with or without a coating at, for example, coating weights of from 0.1 to about 5 and preferably 0.2 to 1.25 weight percent, which coatings are comprised of for example fluoropolymers, including polyvinylidene fluoride commercially available from E. I. duPont Company. Additionally, there can be selected nodular carrier beads of nickel characterized by surfaces of reoccurring recesses and protrusions, as described in U.S. Pat. Nos. 3,847,604 and 3,767,598, the disclosures of which are totally incorporated herein by reference, thus providing particles with a relatively large external area. Other coatings include terpolymers of styrene, reference U.S. Pat. Nos. 3,526,533, and 3,467,634, the disclosures of which are totally incorporated herein by reference, polymethacrylates, and the like. Further, two or more polymer coatings may be selected, reference U.S. Ser. Nos. 136,792 and 136,791, the disclosures of which are totally incorporated herein by reference. The diameter of the coated carrier particles is from about 50 microns to about 1,000 microns, thus allowing the carrier particles to possess sufficient density and inertia to avoid adherence to the electrostatic images during the development process.

The carrier particles are mixed with the toner composition in various suitable combinations, however, best results are obtained with from about 1 part by weight of toner particles to about 100 parts to 1,000 parts by weight of carrier particles are selected. Preferred are developer compositions wherein the toner concentration varies from about 1 percent to about 5 percent.

Preferred polymer resins selected for the toner compositions of the present invention, and wherein the release fluid is incorporated therein include polymers of the polyester group with segments of dimethyl siloxane in the backbone thereof. These polyesters consist of A and B units illustrated hereinafter, reference those of Formula II, for example; the A unit could be poly 1,3-butylene terephthalate, poly 1,2-propylene terephthalate, poly diethylene glycol terephthalate, poly 1,2-propylene isophthalate, polyethylene isophthalate, poly Dow 565 (the diether of propylene glycol and bisphenol A) phthalate, poly Dow 565 isophthalate, poly Dow 565 terephthalate, poly hydroquinone-di-(β-hydroxyethyl)ether azelate, poly hydroquinone di-(β-hydroxyethyl) ether phthalate, poly hydroquinone di-(β-hydroxyethyl) ether isophthalate, poly para-xylylene adipate, poly para-xylylene sebacate, or copolyesters such as those obtained from (50/50 input weight percent) 1,2-propylene terephthalate/1,3-butylene terephthalate; (80/20 input weight percent) 1,2-propylene terephthalate/hydroquinone di-(β-hydroxyethyl) ether terephthalate; (80/20 input weight percent) 1,2-propylene terephthalate/Dow 565 terephthalate; and the like, randomly polymerized with the B unit comprised of, for example, poly dimethyl siloxane terephthalate. These polymers may be polymerized with branching/cross-linking agents such as glyercol, pentaerythritol, trimethylol propane and the like. The total polymer chain may contain an average of from one to about 30 A units and from 1 to about 10 B units. The B unit further may vary from a molecular weight of about 400 to about at least 44,000 as the dimethyl siloxane segments n are increased from 1 to about at least 200.

$$[A\text{-}]_x[\text{-}B]_y \qquad \text{II.}$$

where x = 1 to about 30 y = 1 to about 10, and A and B are randomly polymerized together

AND

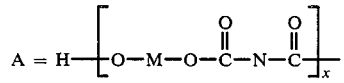

OR

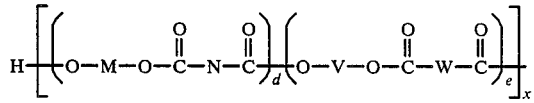

AND

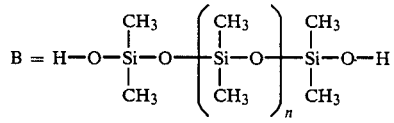

where d and e are 0.01 to 0.99 such that d+e=1, and M and V are organic structures such as alkylene, 1 to about 25 carbon atoms, arylene, 6 to about 24 carbon atoms, and the like from the diol part of the polymer structure, and N and W are organic structures such as alkylene, arylene, and the like from the diacid part of the polymer structure such that the resulting polymer preferably has a glass transition temperature (Tg) of at least about 45° C.; and n and x are as defined herein.

Examples of M and V are 1,2-propylene

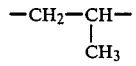

1,3-butylene

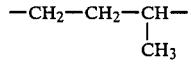

ethylene, $—CH_2CH_2—$, and the like. Examples of N and W are the terephthalates terephthalate; isophthalate;

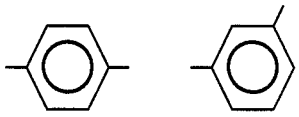

adipate $—CH_2—CH_2—CH_2—CH_2—$; and the like.

Block copolymers of the polyester type illustrated herein can be synthesized by condensation polymerization wherein disilanol terminated polydimethyl siloxanes, such as those obtained from Dynamit Nobel-Petrarch Systems, are reacted with the diacid or diester and dialcohol monomers illustrated herein. In one example, these black copolymers are prepared by the addition of disilanol terminated polydimethyl siloxane of from 1 to about at least an average of 200 segments.

Various imaging members can be selected for permitting the formulation of latent electrostatic images thereon which are subsequently developed with the compositions of the present invention. Examples of imaging members include inorganic components such as selenium, selenium alloys, halogen doped selenium compositions, halogen doped selenium alloys, hydrogenated amorphous silicone with from about 10 to about 50 atomic percent hydrogen, and layered photoresponsive imaging members comprising a generating layer and a transporting layer as illustrated in U.S. Pat. No. 4,265,990, the disclosure of which is totally incorporated herein by reference. Examples of generating layers are trigonal selenium, metal phthalocyanines, metal free phthalocyanines, and vanadyl phthalocyanine, while examples of transport materials include various aryl amines dispersed in resinous binders. Other organic photoresponsive materials that may be utilized in the practice of the present invention include polyvinyl carbazole, 4-dimethylaminobenzylidene, benzhydrazide; 2-benzylidene-aminocarbazole, (2-nitro-benzylidene)-p-bromoaniline, 2,4-diphenylquinazoline; 1,2,4-triazine; 1,5-diphenyl-3-methyl pyrazoline 2-(4'-dimethyl-amino phenyl)-benzoxazole; 3-amino-carbazole; polyvinylcarbazole-trinitrofluorenone charge transfer complex; and mixtures thereof.

With further regard to the present invention, the imaging method comprises the formation of a negatively or positively charged electrostatic latent image on a suitable imaging member including those as illustrated hereinbefore, contacting the image with the compositions of the present invention, transferring the image to a suitable substrate such as paper, and permanently affixing the image thereto by various suitable means such as heat.

The toner compositions of the present invention have a triboelectric charge thereon that is variable depending, for example, on the charge enhancing additive selected and the carrier utilized. For example, the triboelectric charge of the toner composition can be from about 10 to about 30 microcoulombs per gram.

The following examples are being supplied to further define specific embodiments of the present invention, it being noted that these examples are intended to illustrate and not limit the scope of the present invention. Parts and percentages are by weight unless otherwise indicated.

EXAMPLE I

There was prepared poly (34.1/63.4/2.5) 1,2 propylene terephthalate/1,3 butylene terephthalate/pentaerythritol terephthalate-block-polysiloxane terephthalate (a polyester with siloxane block segments therein by the condensation polymerization of dimethyl terephthalate, and components consisting of 72.5 percent (50/50 input ratio) of 1,2 propanediol/1,3 butanediol; 25 percent of PS340.5 (Petrarch Systems) polydimethyl siloxane, silanol terminated molecular weight 1,500 to 2,000; and 2.5 percent of pentaerythritol. This reaction was accomplished in the presence of an isopropol titanate catalyst, 0.0176 mole, at a temperature of 200° C., and under a vacuum of from about 500 to about 0.25 millimeter of mercury for about 6 hours. Thereafter, there was added to the polymer in its molten state 3.0 percent of a 250 centistoke mercapto functional silicone oil available from Stauffer-Wacker Chemical. The polymer with oil was then cooled by pouring it into stainless steel trays. The intrinsic viscosity of the resulting polyester polymer with oil was 0.210 as determined with a Cannon-/Ubbelohde viscometer with toluene.

A toner composition comprised of 92.5 weight percent of the above prepared polymer product with silicone oil therein, 6 weight percent of Regal 330® carbon black and 1.5 percent by weight of the charge control additive distearyl dimethyl ammonium methyl sulfate was prepared in an extrusion device. The toner was jet micronized and classified to result in toner particles with a volume medium diameter of 10.69 (GSD 1.4) and a number medium diameter of 4.60 (GSD 1.97).

A developer composition was then formulated by admixing three parts per weight of the above prepared toner per 100 parts per weight of a carrier consisting of Hoegoenes steel core with a 0.2 weight percent coating thereover of Kynar (polyvinylidene fluoride). The toner composition had a triboelectric charge of a positive 17.4 microcoulombs per gram as determined by the standard Faraday Cage method.

It is believed that the above prepared developer composition can be incorporated into a xerographic imaging apparatus with a layered imaging member, reference U.S. Pat. No. 4,265,990, the disclosure of which is totally incorporated herein by reference, and which apparatus contains no silicone fuser oil therein. Images of excellent resolution with substantially no background deposits would be obtainable, and no offsetting to the fuser roll would be observable.

EXAMPLE II

A polyester polymer similar to that of Example I was prepared by repeating the procedure of Example I with the exception that the reaction time was about 6.5 hours, and there was selected for reaction with the dimethyl terephthalate 72.5 percent (50/50 input ratio) of 1,2 propanediol/1,3 butanediol; 25.0 percent of PS341 (Petrarch Systems) polydimethyl siloxane, silanol terminated molecular weight 4,200; and 2.5 percent of pentaerythritol. The intrinsic viscosity of the resulting polymer was 0.232.

Toner and developer compositions were prepared by repeating the procedure of Example I and substantially similar results can be obtained when incorporating such compositions into the xerographic imaging apparatus mentioned.

The toner of this example had a triboelectric charge thereon of a positive 19.1 microcoulombs per gram at a toner concentration of 2.5 percent, that is when 2.5 parts by weight of the toner were admixed with 100 parts by weight of the carrier particles. Also, the volume medium diameter for the toner particles of this example (Example II) was 10.26 (GSD 1.36), and the number medium diameter was 2.34 (GSD 3.41).

EXAMPLE III

A polyester was prepared by repeating the procedure of Example II with the exception that the reaction time was 7 hours. For reaction with the dimethyl terephthalate, there was selected 87.5 percent (50/50 input ratio) of 1,2 propanediol/1,3 butanediol; 10.0 percent of PS341 (Petrarch Systems) polydimethyl siloxane, silanol terminated molecular weight 4,200; and 2.5 percent of pentaerythritol. The polymer product had an intrinsic viscosity of 0.260.

Toner and developer compositions were prepared by repeating the procedure of Example I and substantially similar results can be obtained when incorporating such compositions into the xerographic imaging apparatus mentioned.

The toner composition of this example had a triboelectric charge of 27.9 (positive) microcoulombs per gram and a toner concentration of 2.7 percent. Also, the volume medium diameter of the toner particles was 9.71 (GSD 1.4), and a number medium diameter of 5.83 (GSD 1.56).

Other modifications of the present invention will occur to those skilled in the art based upon a reading of the present disclosure. These are intended to be included within the scope of this invention.

What is claimed is:

1. A toner composition for utilization in electrophotographic imaging systems wherein release management devices are avoided, which compositions are comprised of pigment particles and resin particles comprised of a polyester with siloxane block segments therein, which polyester has incorporated therein silicone release fluid additives.

2. A toner composition in accordance with claim 1 wherein the polyester resin particles are present in an amount of from about 10 percent by weight to about 90 percent by weight.

3. A toner composition in accordance with claim 1 wherein the pigment particles are present in an amount of from about 1 percent by weight to about 25 percent by weight.

4. A toner composition in accordance with claim 1 wherein the polyester is poly (34.1/63.4/2.5) 1,2-propylene terephthalate/1,3-butylene terephthalate/pentaerythritol terephthalate-block-polysiloxane terephthalate.

5. A toner composition in accordance with claim 1 wherein the polyester is polyalkylene terephthalate/butylene terephthalate/pentaerythritol terephthalate-block-polysiloxane terephthalate.

6. A toner composition in accordance with claim 1 wherein the pigment particles are carbon black.

7. A toner composition in accordance with claim 1 wherein the release additive is comprised of silicone oils.

8. A toner composition in accordance with claim 1 containing charge enhancing additives.

9. A toner composition in accordance with claim 8 wherein the charge enhancing additives are selected from the group consisting of alkyl pyridinium halides, organic sulfate and sulfonate compositions; and distearyl dimethyl ammonium methyl sulfate.

10. A toner composition in accordance with claim 1 containing surface additives selected from the group consisting of colloidal silicas, metal salts, and metal salts of fatty acids.

11. A developer composition comprised of the toner composition of claim 1 and carrier particles.

12. A developer composition in accordance with claim 11 wherein the carrier particles contain thereover a coating.

13. A developer composition in accordance with claim 12 wherein the coating is a polymer selected from the group consisting of polyvinylidene fluoride, polymethyl methacrylate, vinylchloride-chlorotrifluoroethylene, and styrene methyl methacrylate triethoxy silane terpolymer.

14. A developer composition in accordance with claim 11 wherein the polyester toner resin particles are comprised of poly (34.1/63.4/2.5) 1,2-propylene terephthalate/1,3-butylene terephthalate/pentaerythritol terephthalate-block-polysiloxane terephthalate.

15. A developer composition in accordance with claim 11 wherein the polyester toner resin particles are comprised of polyalkylene terephthalate/butylene terephthalate/pentaerythritol terephthalate-block-polysiloxaneterephthalate.

16. A developer composition in accordance with claim 11 wherein the release additives are comprised of silicone oils.

17. A toner composition in accordance with claim 1 wherein the polyester is prepared by the condensation polymerization of a dialkyl terephthalate with a dialcohol, which polymerization is accomplished by heating said components in the presence of a catalyst.

18. A toner composition comprised of resin particles comprised of a polyester with siloxane block segments therein, which polyester has incorporated therein release additives, and pigment particles.

19. A process for enabling the development of images in electrostatographic imaging processes wherein costly release management components are avoided, which comprises (1) providing the toner compositions of claim 1; (2) incorporating the aforementioned toner composition in a xerographic imaging device; (3) forming a latent electrostatic image on a photoreceptor member contained in said device; (4) developing the image with said toner composition; (5) transferring the image to a suitable substrate, and subsequently affixing the image thereto by heating wherein the release fluid present in the toner polymer is transported in a controlled manner to a fuser roll.

20. A process for the development of images which comprises forming a latent image on an imaging member containing an electrophotographic imaging apparatus; developing this image with the toner composition of claim 1; transferring the image to a suitable substrate; and subsequently affixing the image thereto by heating, wherein the release fluid present in the toner polyester polymer is transported in a controlled manner to a fuser roll.

21. A toner composition comprised of particles of a polyester with siloxane block segments therein, which polyester has incorporated therein release additives.

22. A toner composition according to claim 21 wherein the siloxanes selected for formation of the polyester is of Formula I wherein n represents the number of repeating units.

23. A toner composition according to claim 21 wherein the polyester is of the following Formula II $$[A\text{-}\!\!\!

-continued

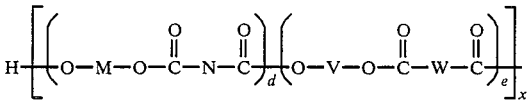

and

B is the group 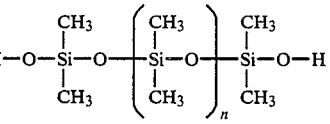

where x is from 1 to about 30; y is from 1 to about 10; A and B are randomly polymerized together; d and e are 0.01 to 0.99 with the sum of d+e being equal to 1; M, V, N and W are organic components; and n represents the number of repeating units.

24. A toner composition according to claim 1 wherein the siloxanes selected for formation of the polyester is of Formula I wherein n represents the number of repeating units.

25. A toner composition according to claim 2 wherein the polyester is of the Formula of claim 23.

26. A toner composition according to claim 21 containing pigment particles.

27. A toner composition according to claim 22 containing pigment particles.

28. A toner composition according to claim 23 containing pigment particles.

29. A toner composition comprised of a polyester with siloxane black segments therein and release additives.

30. A toner composition in accordance with claim 29 containing pigment particles.

31. A developer composition comprised of the toner of claim 29 and carrier particles.

* * * * *